US008713753B2

(12) United States Patent
Lim

(10) Patent No.: US 8,713,753 B2
(45) Date of Patent: May 6, 2014

(54) NOZZLE FOR A VACUUM CLEANER

(75) Inventor: Seung-Heun Lim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 626 days.

(21) Appl. No.: 12/999,183

(22) PCT Filed: May 27, 2009

(86) PCT No.: PCT/KR2009/002797
§ 371 (c)(1),
(2), (4) Date: Dec. 15, 2010

(87) PCT Pub. No.: WO2009/154360
PCT Pub. Date: Dec. 23, 2009

(65) Prior Publication Data

US 2011/0088207 A1 Apr. 21, 2011

(30) Foreign Application Priority Data

| | | |
|---|---|---|
| Jun. 18, 2008 | (KR) | 10-2008-0057361 |
| Oct. 9, 2008 | (KR) | 10-2008-0099187 |
| Oct. 9, 2008 | (KR) | 10-2008-0099191 |
| Oct. 9, 2008 | (KR) | 10-2008-0099193 |
| Feb. 20, 2009 | (KR) | 10-2009-0014133 |

(51) Int. Cl.
*A47L 5/00* (2006.01)
*A47L 9/02* (2006.01)
*A47L 9/20* (2006.01)

(52) U.S. Cl.
USPC ..... 15/382; 15/347; 15/419; 15/421

(58) Field of Classification Search
USPC ..... 15/347, 379–382, 419, 421
IPC ..... A47L 5/00,9/02, 9/20
See application file for complete search history.

(56) References Cited

FOREIGN PATENT DOCUMENTS

| | | | |
|---|---|---|---|
| DE | 196 17 128 | A1 | 10/1997 |
| FR | 805369 | A | 11/1936 |
| GB | 2 419 276 | A | 4/2006 |
| JP | 01-223917 | A | 9/1989 |
| JP | 03-083112 | U | 8/1991 |
| JP | 08-294468 | A | 11/1996 |
| JP | 09-182679 | A | 7/1997 |
| JP | P3094012 | | 7/2000 |
| JP | 2002-078651 | A | 3/2002 |
| JP | 2007-000446 | A | 1/2007 |
| JP | 2009-066330 | A | 4/2009 |
| KR | 20-1995-0009287 | Y1 | 10/1995 |

(Continued)

OTHER PUBLICATIONS

International Search Report issued in PCT Application No. PCT/KR2009/002797 dated Nov. 17, 2009.

(Continued)

*Primary Examiner* — David Redding
(74) *Attorney, Agent, or Firm* — KED & Associates, LLP

(57) ABSTRACT

Provided is a nozzle for a vacuum cleaner. The nozzle for the vacuum cleaner includes a nozzle body defining an outer appearance thereof, a vibration member disposed in the nozzle body, the vibration member separating foreign substances from a surface to be cleaned, a driving motor providing a driving force to the vibration member, and a power transmission unit configured to convert a rotation movement of the driving motor into a linear movement of the vibration member. The vibration member repeatedly strikes the surface to be cleaned by the driving force of the driving motor. The nozzle for the vacuum is advantageous in that it can easily suck dusts scattered during cleaning.

9 Claims, 18 Drawing Sheets

(56) References Cited

FOREIGN PATENT DOCUMENTS

| | | | |
|---|---|---|---|
| KR | 10-0155673 | B1 | 12/1998 |
| KR | 20-2000-0007113 | U | 4/2000 |
| KR | 10-2000-030910 | | 6/2000 |
| KR | 10-0382468 | B1 | 5/2003 |
| KR | 10-2003-0044210 | A | 6/2003 |
| KR | 10-2003-0044213 | | 6/2003 |
| KR | 10-2004-0050217 | A | 6/2004 |
| KR | 10-0638205 | B1 | 10/2006 |
| KR | 10-0676767 | B1 | 2/2007 |
| KR | 10-2007-0087357 | A | 8/2007 |
| WO | WO 2006/106278 | A1 | 10/2006 |

OTHER PUBLICATIONS

European Search Report dated Nov. 9, 2011 issued in Application No. 09 76 6785.

Korean Decision to Grant a Patent dated May 30, 2011 issued in Application No. 10-2008-0099193.

Russian Office Action dated May 24, 2011 issued in Application No. 2010152558 (with translation).

Russian Office Action dated Jul. 26, 2011 issued in Application No. 2010152558.

Korean Notice of Allowance dated Aug. 30, 2011 issued in Application No. 10-2008-0099187.

Korean Office Action dated Jun. 11, 2010 issued in Application No. 10-2008-0057361.

Korean Office Action dated Sep. 29, 2010 issued in Application No. 10-2008-0099187.

Korean Office Action dated Sep. 30, 2010 issued in Application No. 10-2008-0099191.

Korean Office Action dated Sep. 30, 2010 issued in Application No. 10-2008-0099193.

Korean Office Action dated Dec. 9, 2010 issued in Application No. 10-2009-0014133.

NOZZLE FOR A VACUUM CLEANER

CROSS-REFERENCE TO RELATED APPLICATIONS

The present application claims priority under 35 U.S.C. 119 and 35 U.S.C. 365 to Korean Patent Application No. 10-2008-0057361 (filed on Jun. 18, 2008), No 10-2008-0099187 (filed on Oct. 9, 2008), No. 10-2008-0099191 (filed on Oct. 9, 2008), No. 10-2008-0099193 (filed on Oct. 9, 2008) and No. 10-2009-0014133 (filed on Feb. 20, 2009), which is hereby incorporated by reference in its entirety.

BACKGROUND

Embodiments relate to a nozzle for a vacuum cleaner, and more particularly, to a nozzle for a vacuum cleaner including a vibration member for repeatedly striking a surface to be cleaned.

Generally, vacuum cleaners are devices that suck air containing dusts using a suction force generated by a suction motor installed inside a main body to filter the dusts in the main body.

Such a vacuum cleaner includes a suction nozzle for sucking air containing dusts on a surface to be cleaned (hereinafter, referred to as a cleaning surface), a dust separator for separating the dusts from the air sucked through the suction nozzle, and a dust collector in which the dusts separated by the dust separator are stored, and a cleaner body in which the dust collector is installed.

A user cleans a cleaning surface while the suction nozzle is moved on the cleaning surface.

However, when a cleaning surface, e.g., a cleaning surface such as bedding on which a large amount of fine dusts exists is cleaned, the bedding may be closely attached onto the suction nozzle. Thus, there is a limitation that air may not be smoothly sucked into the suction nozzle.

Also, there is a limitation that the fine dusts on the bedding may not be smoothly sucked into the suction nozzle, but be scattered around the suction nozzle.

SUMMARY

Embodiments provide a nozzle for a vacuum cleaner in which dusts are easily separated from a surface to be cleaned to smoothly suck the dusts.

Embodiments also provide a nozzle for a vacuum cleaner in which dusts sucked through the nozzle are checked through the user's eyes.

In one embodiment, a nozzle for a vacuum cleaner includes: a nozzle body defining an outer appearance thereof; a vibration member disposed in the nozzle body, the vibration member separating foreign substances from a surface to be cleaned; a driving motor providing a driving force to the vibration member; and a power transmission unit configured to convert a rotation movement of the driving motor into a linear movement of the vibration member, wherein the vibration member repeatedly strikes the surface to be cleaned by the driving force of the driving motor.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
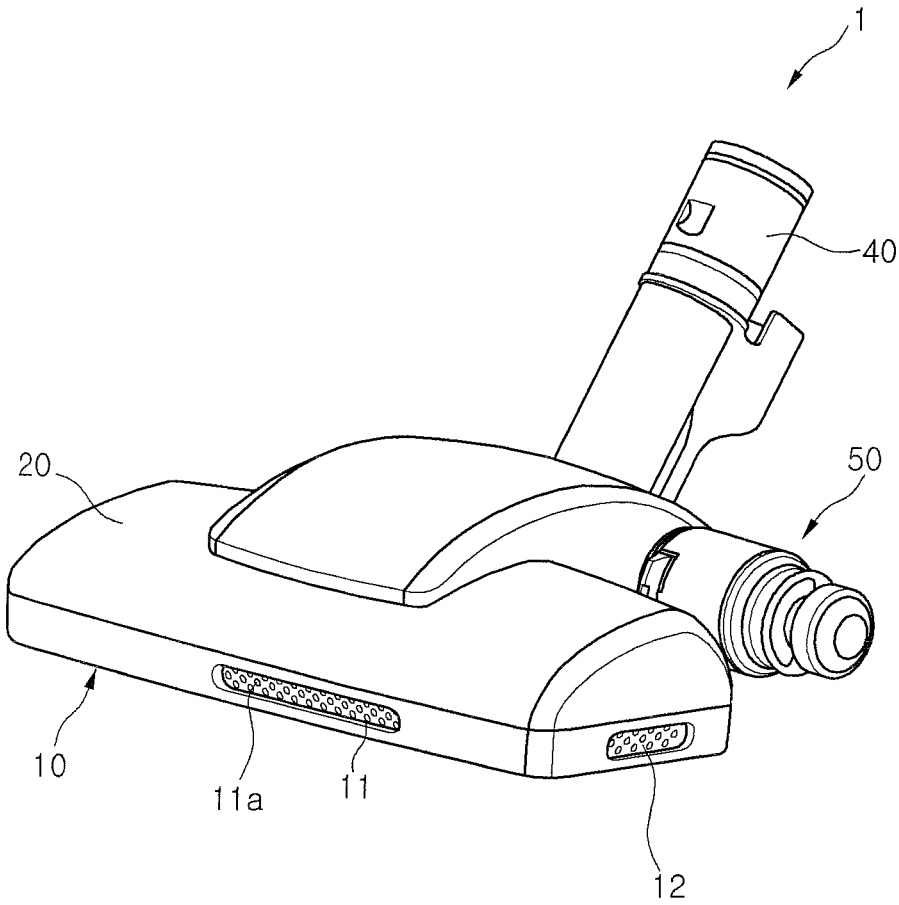
FIG. 1 is a perspective view of a nozzle for a vacuum cleaner according to a first embodiment.
Figure 2:
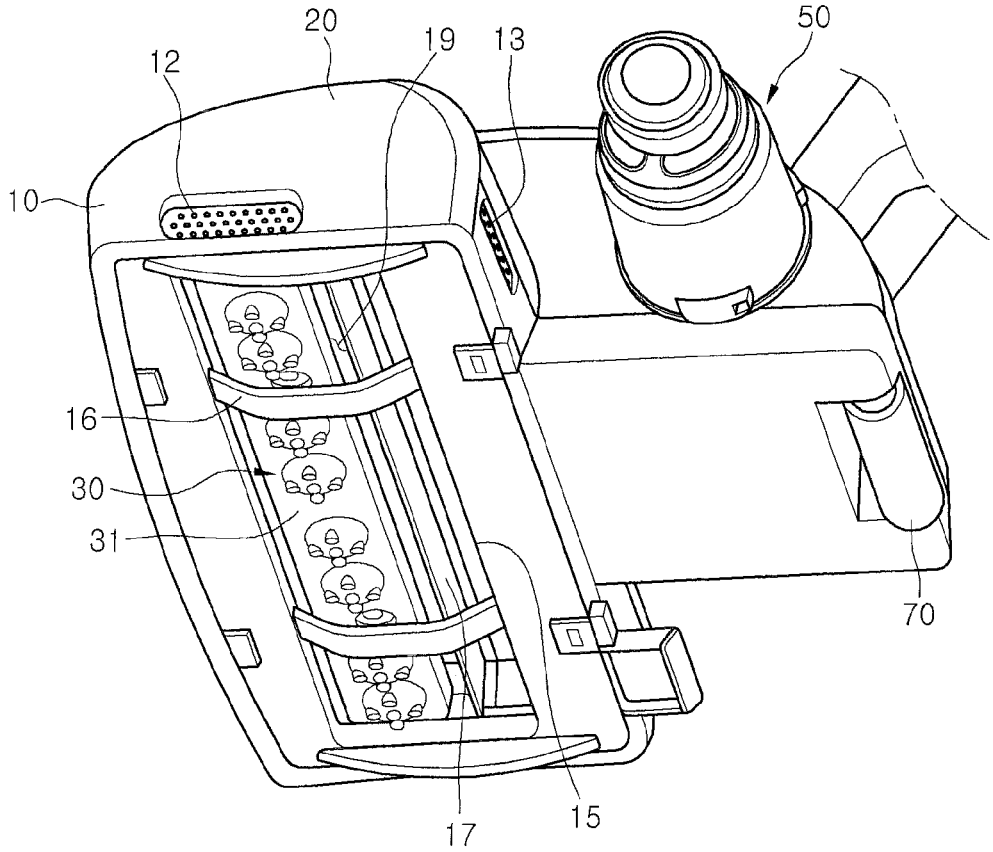
FIG. 2 is a bottom perspective view of the nozzle for the vacuum cleaner according to the first embodiment.
Figure 3:
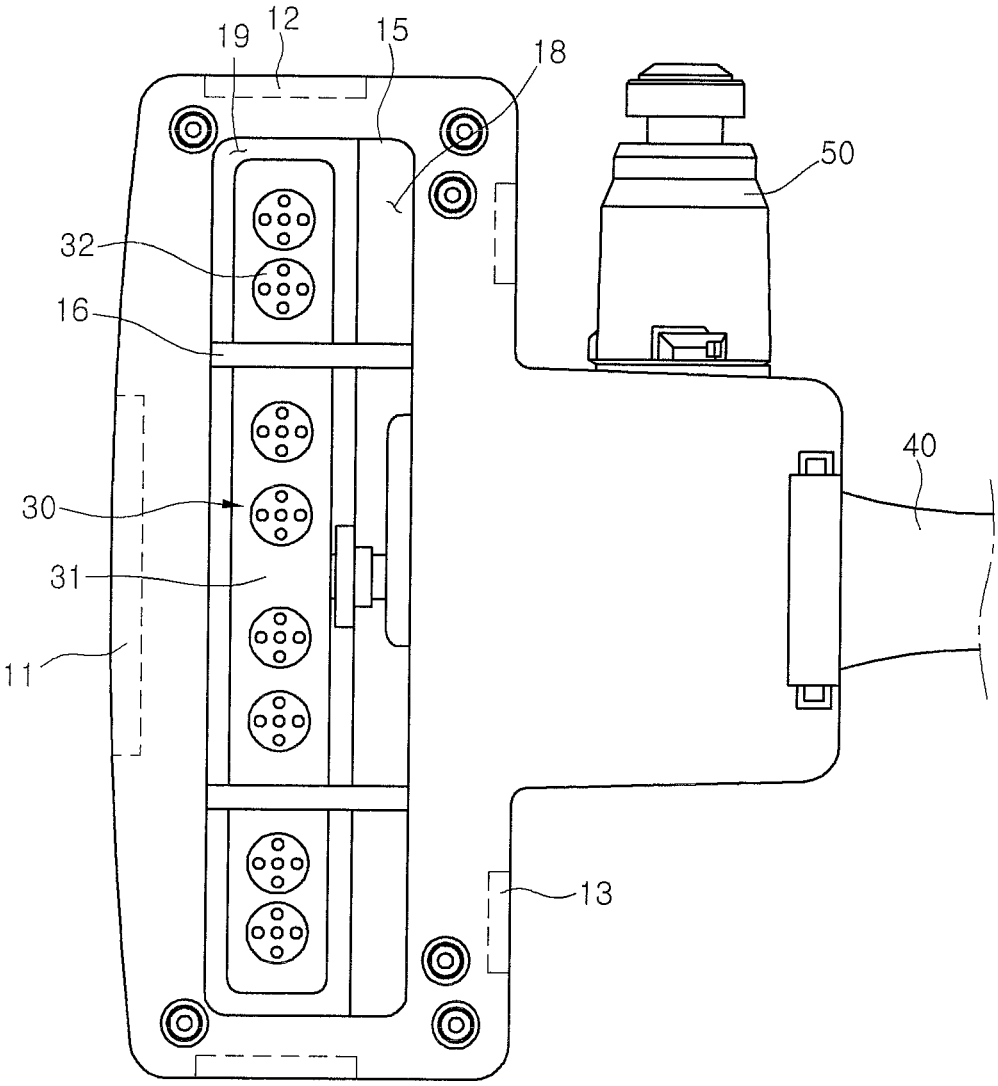
FIG. 3 is a bottom view of the nozzle for the vacuum cleaner according to the first embodiment.

FIG. 1 is a perspective view of a nozzle for a vacuum cleaner according to a first embodiment. FIG. 2 is a bottom perspective view of the nozzle for the vacuum cleaner according to the first embodiment. FIG. 3 is a bottom view of the nozzle for the vacuum cleaner according to the first embodiment.

Referring to FIGS. 1 to 3, a nozzle 1 of a vacuum cleaner according to a first embodiment includes a nozzle body 10 defining a lower outer appearance thereof, an upper cover 20 for covering an upper side of the nozzle body 10, a connection tube 40 disposed at a rear side of the nozzle body 10, and a dust separation unit 50 for separating dusts from air sucked into the nozzle body 10.

In detail, the connection tube 40 is rotatably coupled to the nozzle body 10. The connection tube 40 may be connected to an extension tube or a connection hose of a cleaner body (not shown).

In the air sucked into the nozzle body 10, a portion of the dusts contained in the air introduced into the dust separation unit 50 is separated. Then, the air from which the dusts are separated may be introduced into the cleaner body through the connection tube 40.

The nozzle body 10 has an approximately flat rectangular parallelepiped shape. A plurality of auxiliary suction parts is disposed on outer side surfaces of the nozzle body 10.

In detail, the auxiliary suction parts include a front suction part 11 disposed on a front surface of the nozzle body 10, side suction parts 12 disposed on both side surfaces of the nozzle body 10, and a rear suction part 13 disposed on a rear surface of the nozzle body 10.

A plurality of through holes 11*a* through which air containing dusts is movable is defined in the front suction part 11. Each of the through holes 11*a* may have a size enough to allow the dusts to pass through. Although reference numerals are not depicted here, the same through hole as the through holes 11*a* may be defined also in the side suction parts 12 and the rear suction part 13.

When the bedding is cleaned, a user cleans the bedding while the user moves the nozzle 1 in front and rear directions. Here, a vibration member (that will be described later) strikes a surface to be cleaned (hereinafter, referred to as a cleaning surface) to separate dusts from the cleaning surface. Thus, the separated dusts are introduced into the nozzle.

However, a portion of the fine dusts may be scattered around the nozzle. Here, the scattered fine dusts may be moved into the nozzle by suction forces of the auxiliary suction parts 11, 12, and 13.

The upper cover 20 may be formed of a transparent material to allow an operation of the vibration member 30 to be viewed from the outside.

A bottom opening 15 having a predetermined size is defined in the nozzle body 10. The bottom opening 15 includes a receiving space 19 in which the vibration member 30 is received and a main suction hole 18 defined in a side of the receiving space 19 to suck the air containing the dusts.

Here, the main suction hole 18 may be defined in a rear side of the vibration member 30. A rib 17 for partitioning the spaces 18 and 19 may be disposed between the receiving space 19 and the main suction hole 18.

A spacing guide 16 for spacing the nozzle body 10 from the cleaning surface by a predetermined distance is disposed on a bottom surface of the nozzle body 10. The spacing guide 16 may be provided in plurality in front and rear directions of the bottom opening 15. Also, the spacing guide 16 has a downwardly bent portion to space the bottom surface of the nozzle body 10 from the cleaning surface.

The vibration member 30 includes a body part 31 movably disposed by a power transmission part 130 (that will be described later) and a plurality of protrusions 32 disposed on the body part 31 to repeatedly strike the cleaning surface. The protrusions 32 protrude downward from a bottom surface of the body part 31. Since the protrusions protrude toward the cleaning surface to strike the cleaning surface, the dusts may be easily separated from the cleaning surface.

Also, a roller 70 may be disposed on a rear side of the nozzle body 10 to easily move the nozzle. The roller 70 may serve as a moving wheel function of the nozzle 1.

Figure 4:
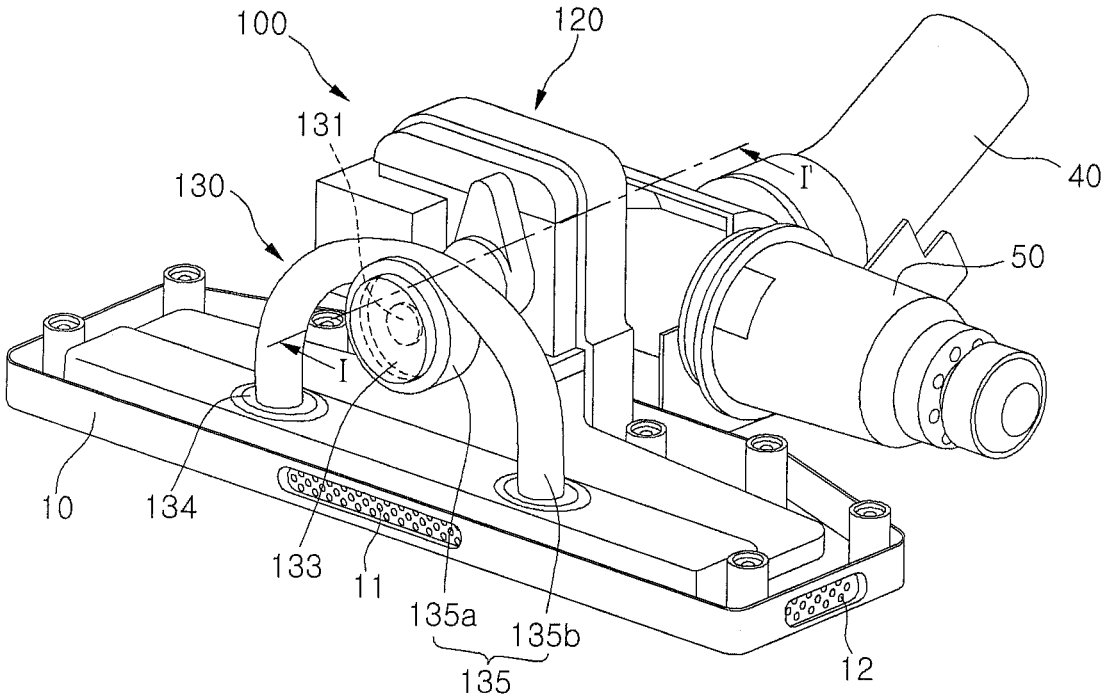
FIG. 4 is a perspective view of the nozzle in a state where an upper cover is removed according to the first embodiment.
Figure 5:
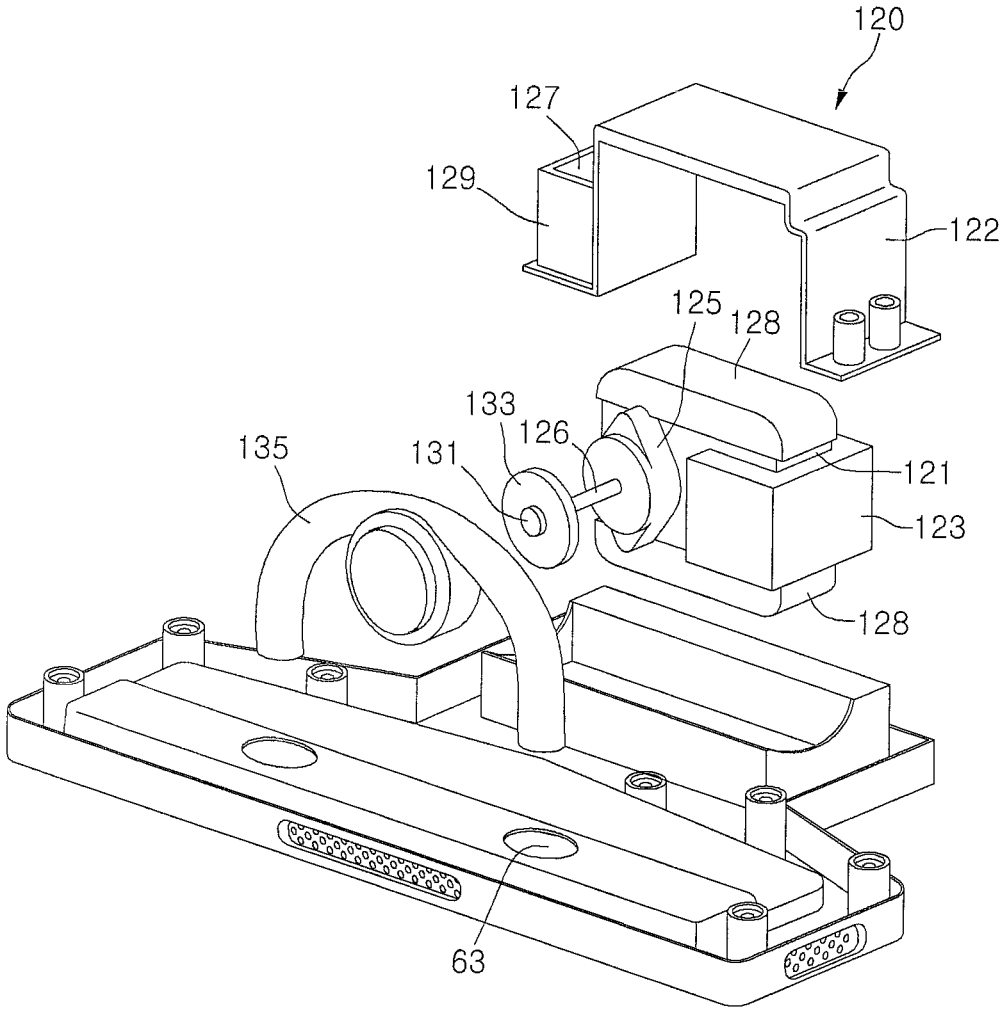
FIG. 5 is an exploded perspective view of the nozzle according to the first embodiment.
Figure 6:
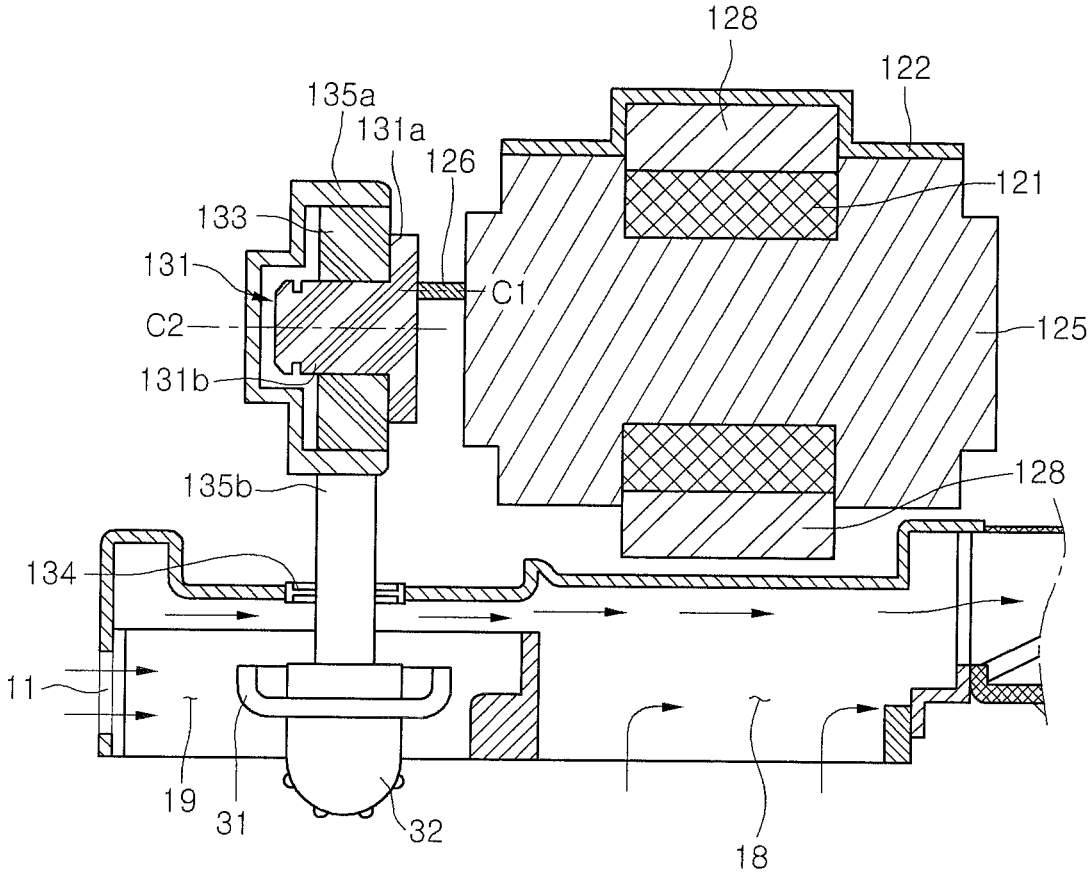
FIG. 6 is a sectional view taken along line I-I' of FIG. 4.

FIG. 4 is a perspective view of the nozzle in a state where an upper cover is removed according to the first embodiment. FIG. 5 is an exploded perspective view of the nozzle according to the first embodiment. FIG. 6 is a sectional view taken along line I-I' of FIG. 4.

Referring to FIGS. 4 to 6, the nozzle body 10 includes a vibration unit 100 for generating vibration.

The vibration unit 100 includes a motor assembly 120 for driving the vibration member 30, the vibration member 30 vibrated by the motor assembly 120, and the power transmission part 130 for transmitting a power of the motor assembly 120 to the vibration member 30.

The motor assembly 120 includes a stator 121 for forming a rotating magnetic field, a rotor unit 125 disposed inside the stator 121 to receive a rotation force according to a polarity of the stator 121, a coil 123 in which a current is supplied to form a magnetic field around the stator 121, an absorption member 128 disposed on at least one side of the stator 121 to absorb vibration and heat generated in the motor assembly 120, and a case 122 covering an outside of the stator 121.

A rotor formed of a permanent magnet and receiving the rotation force generated by the stator 121 may be disposed inside the stator unit 125. A motor shaft 126 rotated together with the stator may be disposed outside the stator.

A circuit part 127 for controlling an operation of the motor assembly 120 and a circuit coupling part 129 for coupling the circuit part 127 to the case 122 are disposed on a side of the case 122. The circuit part 127 may be detachably coupled to the case 122 in one chip shape.

A snubber circuit may be built in the circuit part 127. The snubber circuit is a circuit for attenuating a pick voltage and current generated when motors in which a general coil is operated or other electricity loads are operated. However, the circuit built in the circuit part 127 is not limited to the snubber circuit. For example, different circuit plates for controlling a motor operation may be used.

The absorption member 128 may be disposed over or under the stator 121 to absorb the vibration and heat generated when the motor assembly 120 is operated. The absorption member 128 may be formed of a rubber material to easily absorb the vibration and heat.

The power transmission part 130 includes a rotation body 131, which is rotatably moved by the motor assembly 120, a guide part 135 disposed outside the rotation body 131 and coupled to the vibration member 30, and a bearing 133 disposed between the rotation body 131 and the guide part 135.

In detail, the rotation body 131 includes a circular plate 131*a* connected to the motor shaft 126 and a cylindrical part 131*b* extending from the circular plate 131*a* to a front side of the nozzle 1.

The circular plate 131*a* contacts a side of the bearing 133, and the cylindrical part 131*b* is inserted into the bearing 133. That is, the bearing 133 is disposed along an outer circumference of the cylindrical part 131*b*. Also, the circular plate 131*a* has a diameter greater than that of the cylindrical part 131*b*. The circular plate 131*a* and the cylindrical part 131*b* are concentrically disposed with relation to each other.

A center line C2 of the circular plate 131*a* and the cylindrical part 131*b* is spaced from a center line Cl of the motor shaft 126. Thus, when the motor shaft 126 is rotated, the rotation body 131 is self-rotated and also rotated with a predetermined radius about the motor shaft 122. That is, the rotation body 131 may be eccentrically rotated about the motor shaft 122. Also, the bearing 133 may be rotated with a predetermined radius according to the rotation of the rotation body 131.

The guide part 135 includes a cylindrical coupling part 135*a* surrounding an outer surface of the bearing 133 and a plurality of extension parts 135*b* extending downward from the cylindrical coupling part 135*a*.

The extension parts 135*b* extend roundly downward from one side and the other side of the cylindrical coupling part 135*a*. As shown in FIG. 5, the plurality of extension parts 135*b* may have a "U" shape with respect to a center of the cylindrical coupling part 135*a*.

The guide part 135 may be integrated with the bearing 133 in one body. Here, the guide part 135 may be coupled to an outer circumference of the bearing 133 by a fitting process. Also, the guide part 135 and the rotation body 131 are relatively moved by the bearing 133.

Also, an insertion plate 60 in which the guide part 135 is movably inserted is disposed on the nozzle body 10. Through holes 63 through which the plurality of extension parts 135*b* vertically pass are defined in the insertion plate 60. The extension parts 135*b* pass through the through holes 63 to extend downward, thereby being coupled to the vibration member 30, respectively.

A rotation restriction part 134 for restricting the rotation of the guide part 125 is coupled to the outside of each of both ends of the guide part 135. In detail, the rotation restriction part 134 may be fitted into a lower end of each of the extension parts 135*b* and coupled to an inner circumference of each of the through hole 63.

The rotation restriction part 134 may be formed of a rubber material having a predetermined elasticity. The movement in a direction in which the guide part 135 is rotated is restricted by the rotation restriction part 134. In detail, the extension parts 135*b* are restricted by the rotation restriction part 134 in a process in which the extension part 135*b* are rotated in a predetermined direction according to the rotation of the bearing 133. Thus, the rotation movement of the guide part 135 may be restricted and converted into vertical movements of the extension parts 135*b*.

Figure 7:
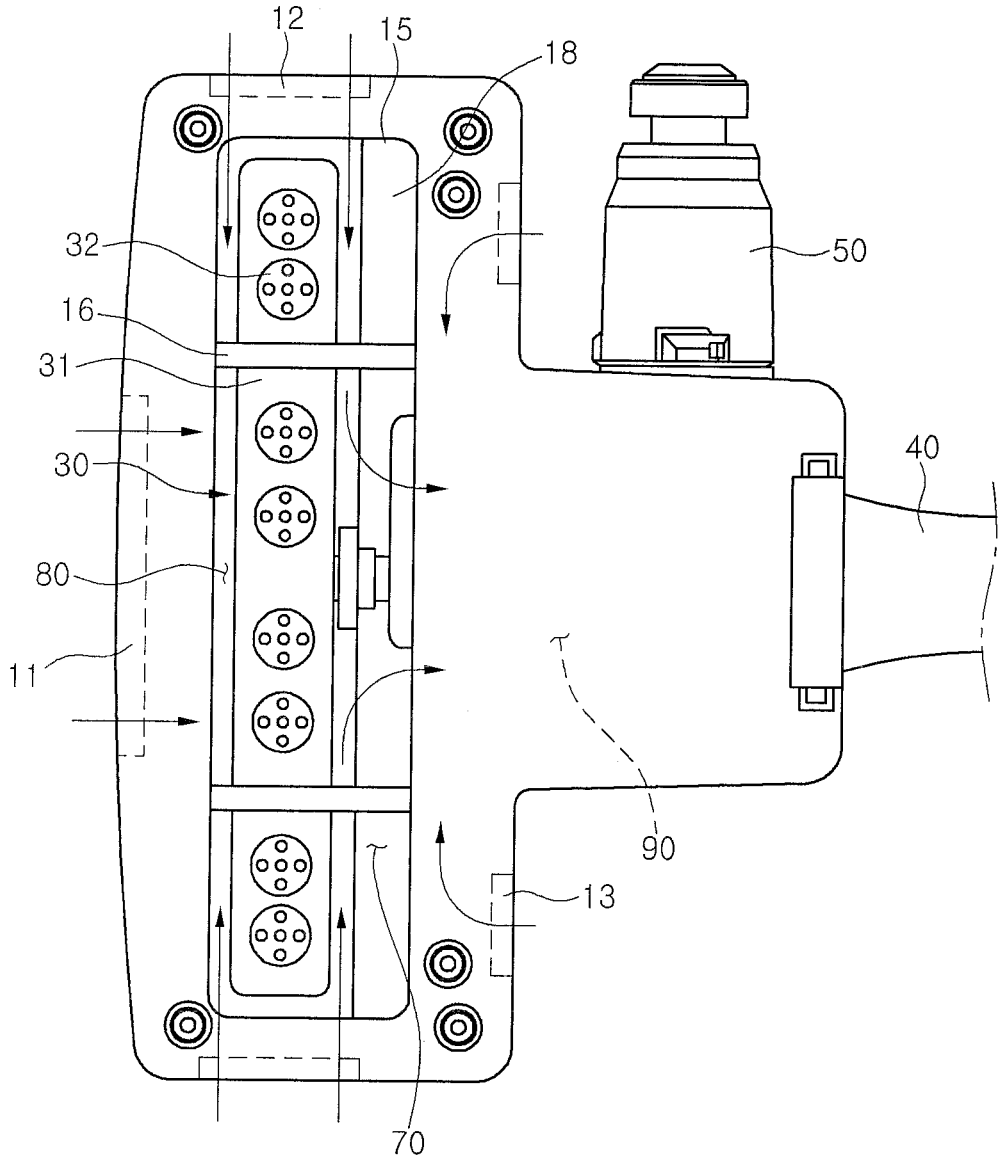
FIGS. 7 and 8 are bottom views illustrating an effect of the nozzle according to the first embodiment.
Figure 8:
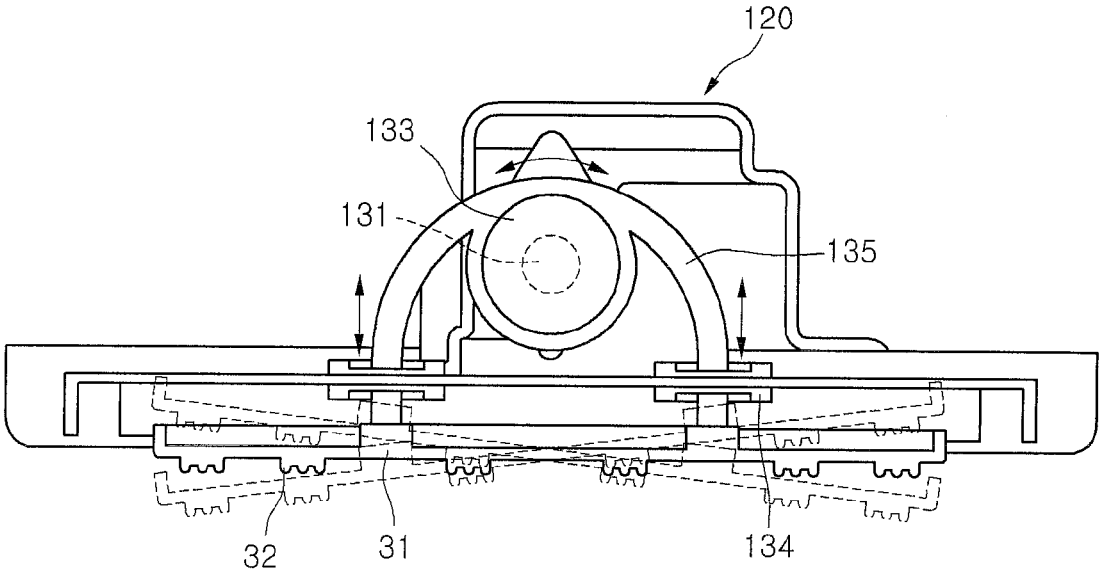

FIGS. 7 and 8 are bottom views illustrating an effect of the nozzle according to the first embodiment.

Referring to FIG. 7, when the suction force is applied to the suction nozzle 1 according to the first embodiment, the sucked dusts are moved toward a rear side of the nozzle, i.e., the connection tube 40 through a first suction passage 70 and a second suction passage 80.

The first suction passage 70 is referred to as a passage through which the air sucked through the main suction hole 18 flows and extends from an upper side of the main suction hole 18 to the connection tube 40.

Also, the second suction passage 80 is referred to as a passage through which the air sucked through the front suction part 11, the side suction parts 12, and the rear suction part 13 flows and extends from the suction parts 11, 12, and 13 to the connection tube 40 via the receiving space 19.

The second suction passage 80 is united with the first suction passage 70 at the upper side of the main suction hole 18 to extend toward the connection tube 40.

Here, a united passage 90 in which the first suction passage 70 and the second suction passage 80 are united with each other is disposed at a rear side of the main suction hole 18. That is, the united passage 90 may be disposed between the connection tube 40 and the vibration member 30.

In detail, the air sucked through the front suction part 11 flows from a front side of the vibration member 30 to a rear side. Also, the air sucked through the side suction parts 12 flows from a side of the vibration member 30 to the rear side. Also, the air sucked through the rear suction part 13 flows toward a front side, and then, the air flows into the first suction passage 70.

The vibration member 30 may be disposed on the second suction passage 80. Also, the vibration member 30 may constitute a portion of the second suction passage 80.

Referring to FIG. 8, the vibration member 30 according to the first embodiment may be vertically vibrated by the operation of the motor assembly 120.

In detail, when a power is applied to the motor assembly 120 to generate a rotation force, the motor shaft 122 is rotated in one direction. Then, the rotation body 131 is self-rotated by the motor shaft 126 and also is rotated with a predetermined radius around the center Cl.

That is, the center C2 of the rotation body 131 is eccentric with respect to the center Cl of the motor shaft 126. The center C2 is rotated around the center Cl of the motor shaft 126. Also, the rotation force of the rotation body 131 is transmitted to the guide part 135.

Here, since the rotation of the guide part 135 is restricted by the rotation restriction part 134, the guide part 135 is not rotated with the rotation body 131 in the same direction, but is relatively moved with respect to the rotation body 131. Thus, both ends of the guide part 135, i.e., the extension parts 135*b* are alternately moved in the vertical direction.

When the guide part 135 is vertically moved, the vibration member 30 is vibrated. In detail, when one end of the vibration member 30 is moved upward, the other end of the vibration member 30 is moved downward. Also, the one end of the vibration member 30 is moved downward, the other end of the vibration member 30 is moved upward.

As described above, since the vibration member 30 is vertically moved, the protrusion 32 strikes the cleaning surface. In this process, the dusts are separated from the cleaning surface. The separated dusts are sucked through the main suction hole 18 and the auxiliary suction parts 11, 12, and 13. Then, the dusts are moved into the connection tube 40 through the first and second suction passages 70 and 80.

As described above, since the plurality of suction holes is defined to suck the dusts therethrough, the dusts may be smoothly sucked. Specifically, since the dusts scattered outside the nozzle during the cleaning are sucked through the plurality of auxiliary suction parts 11, 12, and 13, an amount of the scattered dusts may be minimized. Thus, a clean environment may be realized.

Hereinafter, a second embodiment will be described. The current embodiment is equal to the first embodiment except a constitution of a vibration member. Thus, different points therebetween will be mainly described, and also, the same parts as those of the first embodiment will be denoted by the same description and reference numeral.

Figure 9:
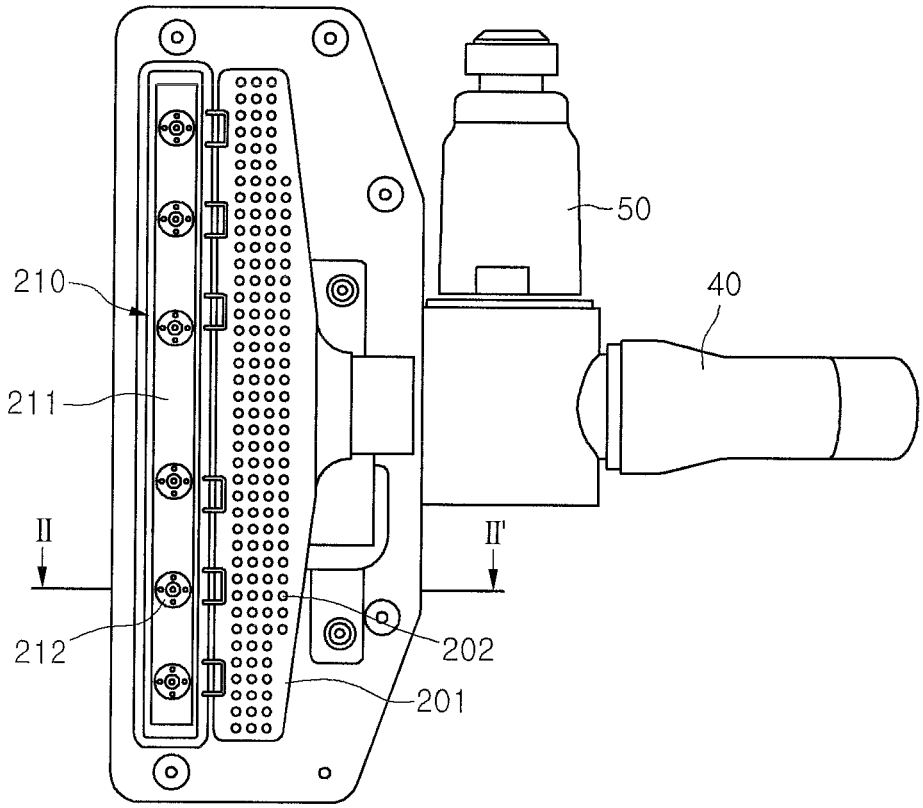
FIG. 9 is a bottom view of a nozzle according to a second embodiment.
Figure 10:
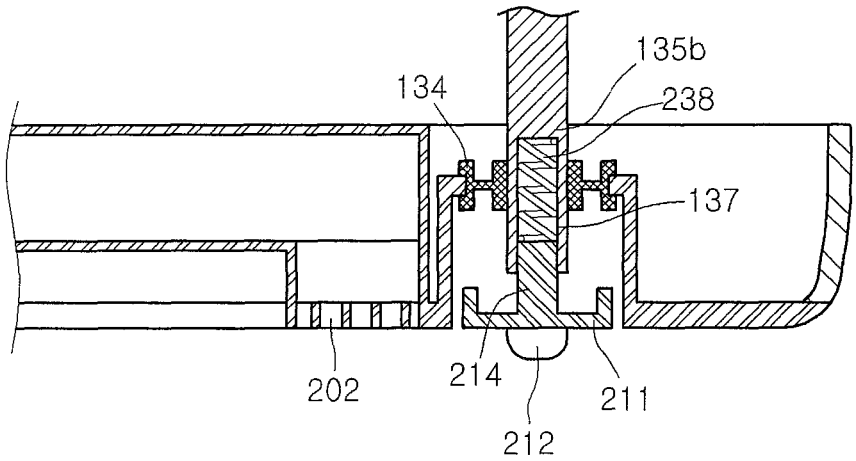
FIG. 10 is a sectional view taken along line II-II' of FIG. 9.

FIG. 9 is a bottom view of a nozzle according to a second embodiment, and FIG. 10 is a sectional view taken along line II-II' of FIG. 9.

Referring to FIGS. 9 and 10, a nozzle 1 according to a second embodiment includes a vibration member 210, which is vibratable. The vibration member 210 includes a body part 211 defining an outer appearance thereof and a plurality of protrusion members 212 for directly striking a cleaning surface during the vibration of the body part 211. The plurality of protrusion members 212 is integrated with the body part 211 in one body and extends downward from the body part 211.

In the current embodiment, since a motor assembly for providing a driving force and a power transmission part for transmitting the driving force of the motor assembly to the vibration member have the same constitution as those of the first embodiment, duplicated descriptions will be omitted here.

A suction plate 201 for sucking dusts separated from the cleaning surface by the vibration member 210 is disposed at a rear side of the vibration member 210. The suction plate 201 may be detachably coupled to a nozzle body 10. The suction plate 201 may serve as "a main suction part" for sucking air containing dusts.

A plurality of suction holes 202 through which the dusts are sucked may be defined in the suction plate 201. The suction holes 202 may be defined in plurality in an entire surface of the suction plate 201.

The vibration member 210 includes a coupling part 214 coupled to an extension part 135*b* of the guide part 135. The coupling part 214 may be provided in number corresponding to that of the extension part 135*b*. Here, the extension part 135*b* may be referred to as "a first coupling part", and the coupling part 214 may be referred to as "a second coupling part".

A rotation restriction part 134 for restricting the rotation of the extension part 135*b* is disposed outside the extension part 135*b*. This description will be denoted by the description of the first embodiment.

In detail, an insertion space 137 in which the coupling part 214 is inserted is defined in the extension part 135*b*. An elastic member 238 for elastically support the coupling part 214 is disposed in the insertion space 137. For example, the elastic member 238 may be a coil spring. The elastic member 238 has one end connected to the extension part 135*b* and the other end connected to the coupling part 214.

Thus, the vibration member 210 may be slidable with respect to the guide part 135 according to a kind of cleaning surfaces.

An effect of the nozzle according to the current embodiment will be described below.

When the cleaning surface is formed of a flexible material such as bedding, the vibration member 210 strikes the bedding to separate dusts from the bedding. Here, since the vibration member 210 compresses the bedding in a direction away from a bottom surface of the nozzle, the vibration member 210 may prevent the cleaning surface such as the bedding from being closely attached to the main suction part 201 of the nozzle to easily suck the dusts into the main suction part 201.

Here, although a reaction force against a force at which the vibration member 210 compresses the bedding is applied to the vibration member 210, the vibration member 210 is not substantially slidable with respect to the guide part 135 because the bedding is formed of the flexible material and the reaction force is generally less than an elastic force of the elastic member 238. On the other hand, the reaction force applied to the vibration member 210 may be greater than the elastic force of the elastic member 238 according to a kind of beddings. In this case, the vibration member 210 may be slidable with respect to the guide part 135.

Also, when the cleaning surface is formed of the flexible material, a configuration of the cleaning surface may be deformed according the compression of the vibration member 210 to absorb the compressing force of the vibration member 210. Thus, when the vibration member 210 strikes the cleaning surface, occurrence of noise may be reduced.

For example, in a case where the cleaning surface is formed of a hard material, when the vibration member 210 compresses the cleaning surface, the cleaning surface does not nearly absorb the compressing force of the vibration member 210. Here, when the vibration unit does not absorb the reaction force applied by the cleaning surface, the vibration member 210 may cause a large noise during the striking of the cleaning surface.

However, according to the current embodiment, since the vibration member 210 is elastically movable by the guide part, the vibration member 210 may be slidable with respect to the guide part by the reaction force of the cleaning surface. Thus, the noise generated when the vibration member 210 strikes the cleaning surface formed of the hard material may be reduced. That is, according to the current embodiment, the reaction force of the cleaning surface may be absorbed by the elastic member 238 disposed on the guide part 135 to reduce the noise.

Thus, since the noise may be reduced by the elastic member 238 in the current embodiment, the elastic member 238 may be referred to as a noise reduction part.

Figure 11:
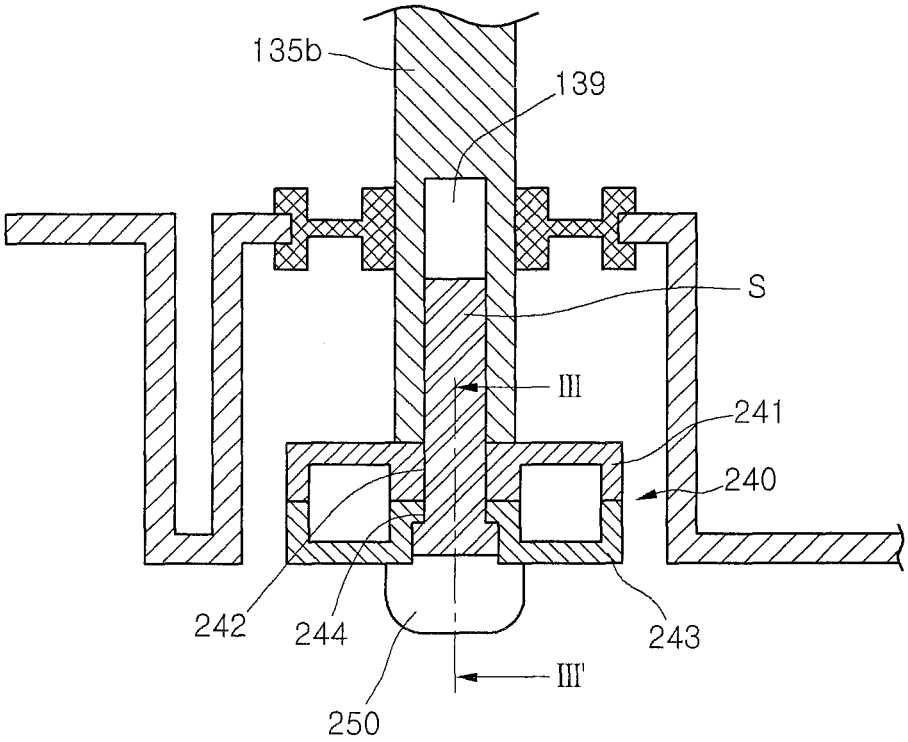
FIG. 11 is a sectional view illustrating a portion of a nozzle according to a third embodiment.
Figure 12:
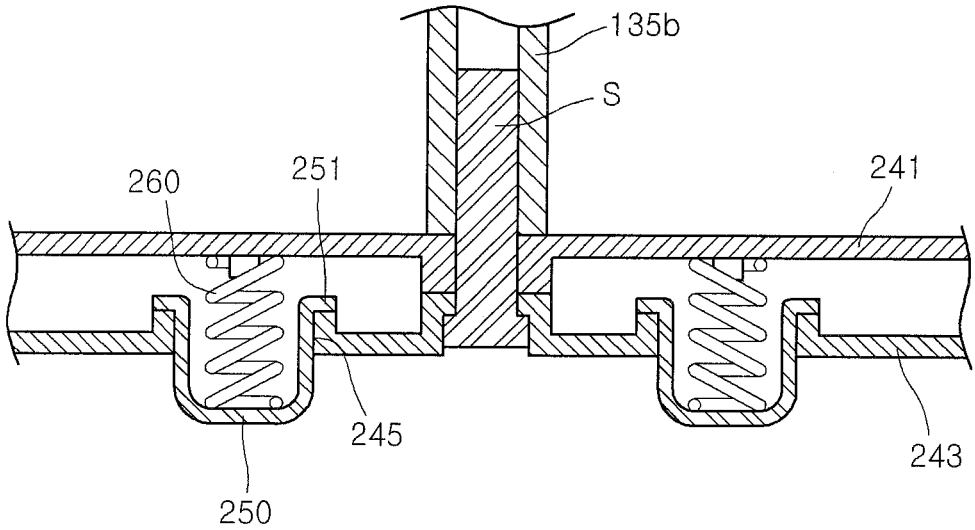
FIG. 12 is a sectional view taken along line III-III' of FIG. 11.

FIG. 11 is a sectional view illustrating a portion of a nozzle according to a third embodiment, and FIG. 12 is a sectional view taken along line of FIG. 11.

Referring to FIGS. 11 and 12, a vibration member 240 according to a third embodiment include an upper body 241 and a lower body 243. Also, a plurality of protrusion members 250 is coupled to the lower body 243.

In detail, coupling holes 242 and 244 to which a coupling member S is coupled are defined in the upper body 241 and the lower body 243. A coupling groove 139 to which the coupling member S passing through the coupling holes 242 and 244 is coupled is defined in an extension part 135*b* of a guide part 135.

A hole 245 through which each of the protrusion members 250 passes is defined in the lower body 243. Each of the protrusion member 250 passes through the hole 245 from an upper side of the lower body 243. Also, the protrusion member 250 passes through the hole 245 to protrude downward from the lower body 243. A seat part 251 for allowing the protrusion member 250 to be seated on a top surface of the lower body 243 in a state where the protrusion member 250 passes through the hole 245 is disposed on the protrusion member 250.

An elastic member 260 (which may also be referred to as a noise reduction part) for elastically supporting the protrusion member 250 is disposed inside a vibration member 240. The elastic member 260 has one end supported by the upper body and the other end supported by the protrusion member 250.

Thus, the protrusion member 250 may be vertically movable with respect to the vibration member 240 according to a kind of cleaning surfaces. That is, the protrusion member 250 may be movable with respect to the guide part 135.

Hereinafter, a fourth embodiment will be described. This embodiment is characterized in that a dust separation unit is provided. Thus, the dust separation unit may be mainly described, and the same parts as those of the foregoing embodiments will be denoted by the same description and reference numeral.

Figure 13:
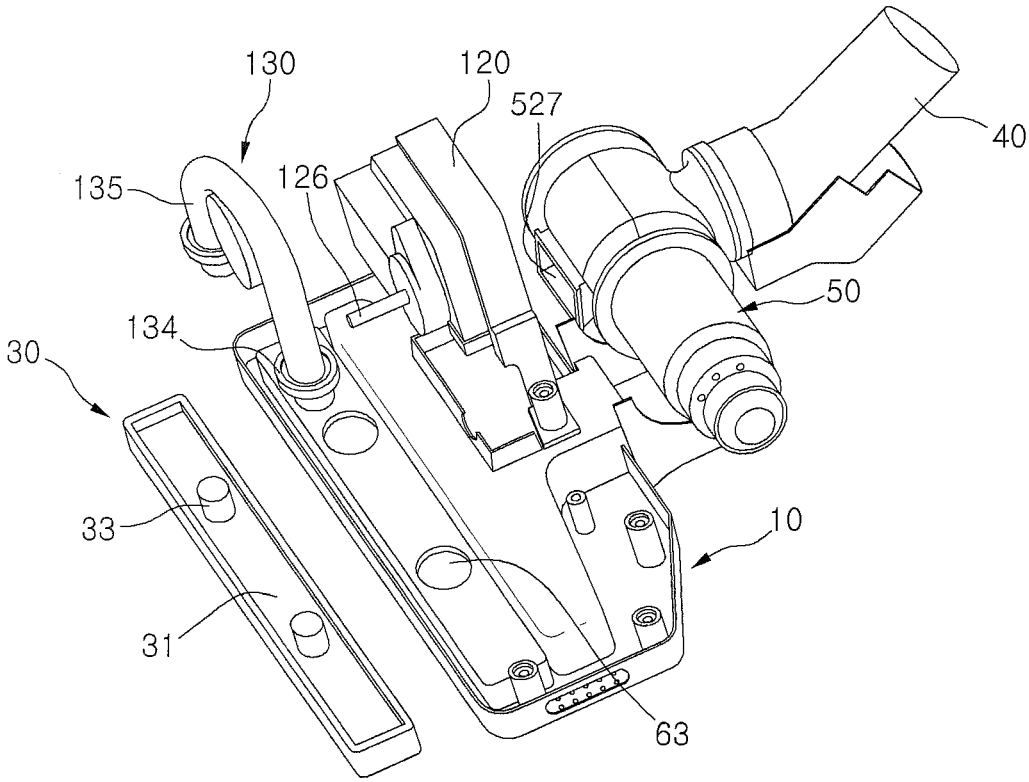
FIG. 13 is an exploded perspective view of a nozzle according to a fourth embodiment.
Figure 14:
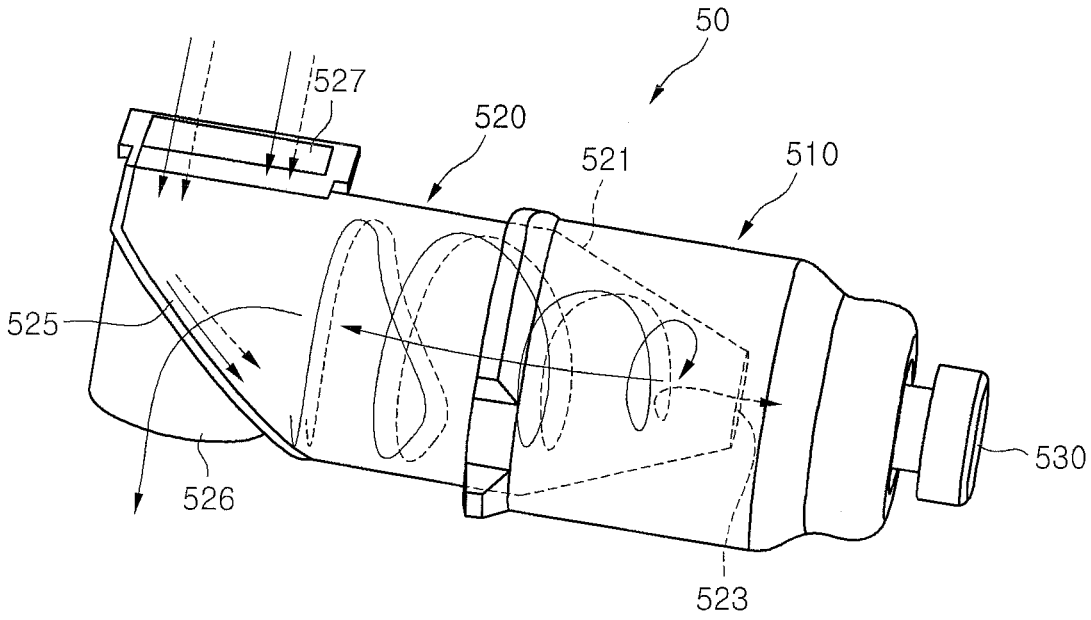
FIG. 14 is a perspective view of a dust separation unit according to the fourth embodiment.
Figure 15:
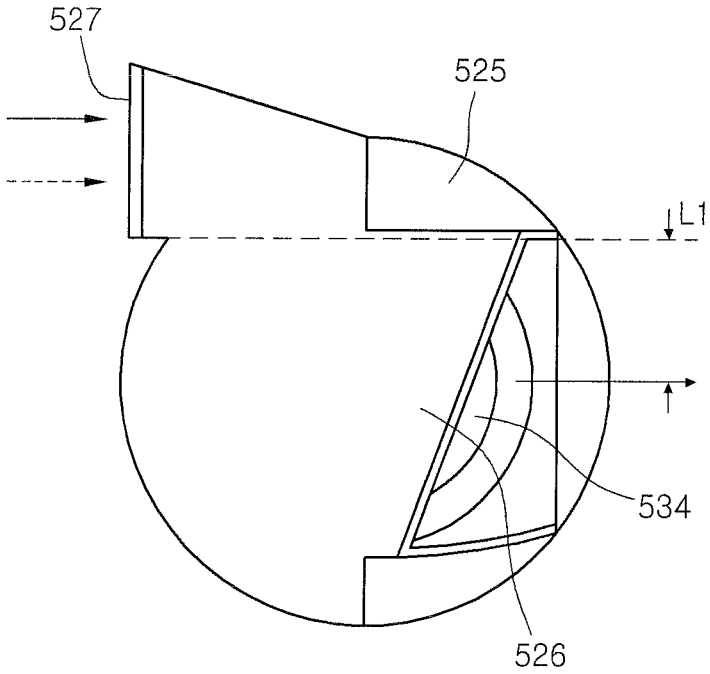
FIG. 15 is a side view of the dust separation unit.

FIG. 13 is an exploded perspective view of a nozzle according to a fourth embodiment. FIG. 14 is a perspective view of a dust separation unit according to the fourth embodiment. FIG. 15 is a side view of the dust separation unit.

Referring to FIGS. 13 to 15, a vibration unit 100 according to a fourth embodiment includes a motor assembly 120 generating a driving force, a vibration member 30 vibrated by the driving force of the motor assembly 120, and a power transmission part 130 for transmitting the driving force of the motor assembly 120 to the vibration member 30.

An insertion plate 60 in which a through hole 63 in which a guide part 135 is inserted is defined is disposed on a nozzle body 10. The vibration member 30 includes a body part 31 defining an outer appearance thereof and a coupling protrusion 33 protruding upward from the body part 31. The coupling protrusion 33 may be coupled to both ends of the guide part 135.

A dust separation unit 50 for separating a portion of dusts contained in sucked air is disposed at a rear side of the nozzle body 10.

The dust separation unit 50 includes a dust separation part 520 for separating dusts from air and a dust container in which the dusts separated by the dust separation part 520 are stored. The dust separation part 520 is fixed to the nozzle body 10, and the dust container 510 is separably coupled to the nozzle body 10 to selectively cover the dust separation part 520.

The dust separation part 520 includes a cyclone part 521 in which the dusts are separated from the air by a cyclone flow. The cyclone part 521 includes a cylindrical part 521*a* (see FIG. 16) having a cylindrical shape and a conical part 521*b* (see FIG. 16) having a diameter gradually decreased from the cylindrical part 521*a*.

A suction port 527 through which air (solid arrow) or dusts (dotted arrow) are sucked is disposed at one side of the cyclone part 521. Also, a dust discharge part 523 through which the dusts are discharged is disposed on the other side of the cyclone part 521.

The suction port 527 communicates with a rear side of the nozzle body 10. Thus, the air sucked through the nozzle body 10 may be moved into the dust separation unit 50 through the suction hole 527. A portion at which the dust discharge part 523 is disposed is inserted into the dust container 510.

The cyclone part 521 includes a guide wall 525 for guiding the air sucked through the suction port 527 to the inside of the cyclone part 521. The guide wall 525 may be rounded toward the inside of the cyclone part 521.

In summary, the air sucked through the suction port 527 is moved into the cyclone part 521 through the guide wall 525. Here, the air is moved toward the dust discharge part 523 along an inner wall of the cyclone part 521 while passing through the cyclone flow.

A portion of the dusts contained in the air is discharged through the dust discharge part 523 and stored in the duct container 510. The air separated from the dusts is moved through the inside of the cyclone part 521 and discharged through an air discharge part 526.

The air discharge part 526 is connected to a connection tube 40. The air discharged through the air discharge part 526 may be moved in a main body of a cleaner through the connection tube 40.

As shown in FIG. 15, the suction port 527 is disposed at a position higher than that of the air discharge part 526. In detail, a lower end of the suction port 527 is disposed at a position higher by a height L1 than a center of the air discharge part 526. The guide wall 525 extends from the suction port 527 toward the inside of the cyclone part 521.

That is, the air discharge part 526 is disposed at a position higher than that of the suction port 527. Since the air sucked through the suction port 527 is guided into the inside of the cyclone part 521 by the guide wall 525, the most of the air sucked through the suction port 527 may be introduced into the cyclone part 521.

However, a portion of the air sucked through the suction port 527 may be moved toward the air discharge part 526 by a flow of the air discharged through the air discharge part 526.

Figure 16:
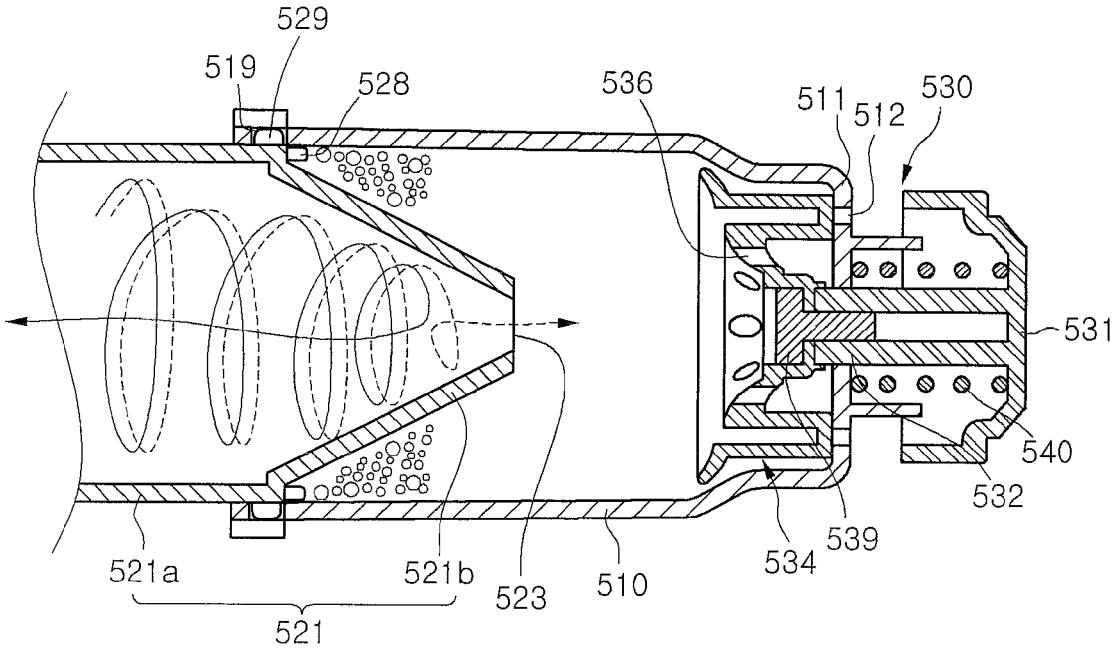
FIG. 16 is a sectional view illustrating an internal structure of the dust separation unit.
Figure 17:
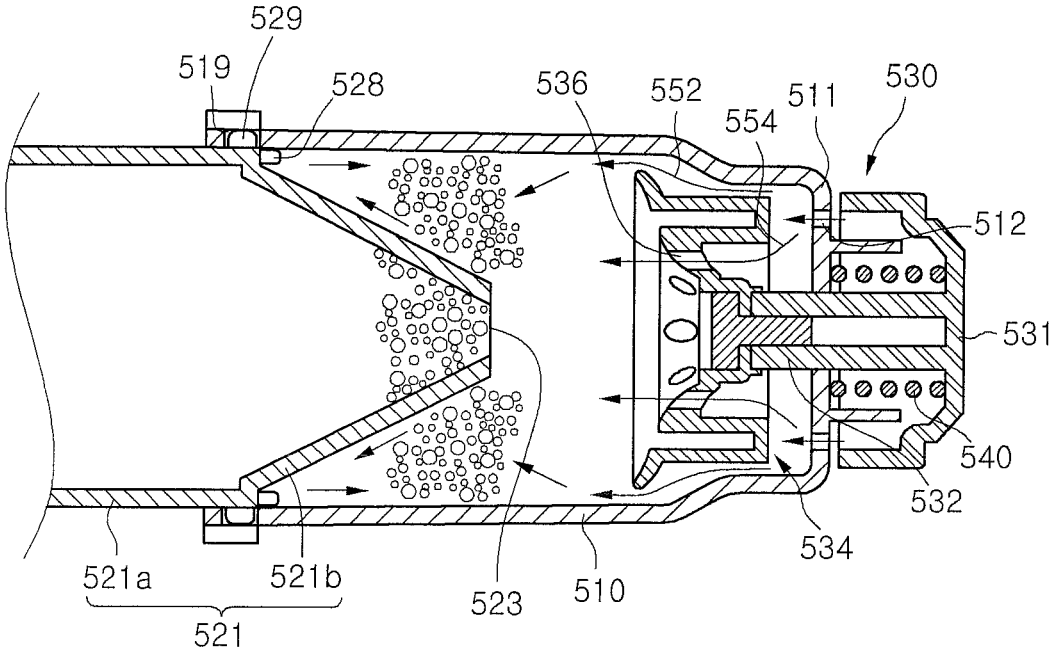
FIG. 17 is a sectional view illustrating an effect of an opening/closing unit according to the fourth embodiment.

FIG. 16 is a sectional view illustrating an internal structure of the dust separation unit, and FIG. 17 is a sectional view illustrating an effect of an opening/closing unit according to the fourth embodiment.

Referring to FIGS. 16 and 17, the dust container 510 according to the fourth embodiment may be separably coupled to the dust separation part 520.

In detail, a hook protrusion 529 by which the dust container 510 is hooked is disposed on the outside of the cyclone part 521. The hook protrusion 529 may be disposed on a boundary between the cylindrical part 521*a* and the conical part 521*b*.

A hook hole 519 in which the hook protrusion 529 is hooked is defined in the dust container 510. The dust container 510 may be rotated in a state where the dust container 510 is fitted into the outside of the dust separation part 520, In this process, the hook protrusion 529 may be inserted and hooked into/by the hook hole 519.

Also, a jamming prevention protrusion 528 for preventing the dusts from being jammed between the cyclone part 521 and the dust container 510 is disposed on the cyclone part 521. The jamming prevention protrusion 528 may be disposed at a narrow ravine between the conical part 521*b* and an outer surface of the dust container 510.

The dust container 510 may be formed of a transparent material to check an amount of dusts stored in the duct container 510 through naked eyes. Also, a plurality of suction holes 512 through which external air within the nozzle body is introduced is defined in the dust container 510.

The suction holes 512 are opened or closed by an opening/closing unit 530. In detail, the opening/closing unit 530 includes a compression button 531 disposed outside the duct container 510, an opening/closing member 534 for opening or closing the suction holes 512, and an elastic member 540 elastically supporting the compression button 531.

In detail, the opening/closing member 534 is coupled to the compression button 532 in the dust container 510. A coupling part 532 coupled to the opening/closing member 534 is disposed on the compression button 531. The coupling part 532 passes through the dust container 510 from the outside of the dust container 510. For example, the coupling part 532 passing through the dust container 510 and the opening/closing member 534 may coupled to each other by a screw 539.

A plurality of through holes 536 through which the air sucked into the dust container 510 through the suction holes 512 pass is defined in the opening/closing member 534.

The elastic member 540 is disposed between the dust container 510 and the compression button 531. The elastic member 540 supports the compression button 531 on the outside of the dust container 510. Also, the elastic member 540 applies an elastic force to allow the opening/closing member 534 to be moved in a direction in which the opening/closing member 534 closes the suction holes 512.

Hereinafter, an effect of the dust separation unit 50 will be described.

Referring to FIG. 17, a cyclone flow occurs inside the cyclone part 521. In a state where an external force is not applied to the compression button 531, a state in which the opening/closing member 534 closes the suction holes 512 is maintained by an elastic force of the elastic member 540. Here, in the state where the opening/closing member 534 closes the suction holes 512, the opening/closing member 534 is closely attached to a surface of the dust container 510 having the suction holes 512.

In this state, when the compression button 531 is compressed, the opening/closing member 534 connected to the compression button 531 is moved in the same direction as a movement direction of the compression button 531. Thus, the suction holes 531 are opened to allow the inside of the dust container 510 to communicate with the outside of the dust container 510. When the suction holes 531 are opened, a first passage 552 through which the sucked air flows is defined between an inner wall of the dust container 510 and the opening/closing member 534.

Thus, as shown in FIG. 17, a portion of the air sucked into the dust container 510 flows into the first passage 552 and is moved toward the cyclone part 521.

Also, since the plurality of through holes 536 is defined in the opening/closing member 534, the other portion of the air sucked into the dust container 510 passes through the through holes 536 and is moved toward the cyclone part 521.

In the current embodiment, a series of passages through which the air sucked into the dust container 510 passes through the through holes 536 and is moved toward the cyclone part 521 may be referred to as a second passage 554. Here, since the through holes 536 constitute a portion of the second passage 554, the opening/closing member 534 may define a portion of the second passage 554.

The second passage 554 may be defined in a central portion of the dust container 510, and the first passage 552 may be defined outside the second passage 554.

A portion of the air flowing into the first passage 552 and the second passage 554 is introduced into the dust separation part 521 through the dust discharge part 523 of the cyclone part 521, and the other portion of the air flows between the outer surface of the cyclone part 521 and the inner surface of the dust container 510.

As described above, when the air flows between the outer surface of the cyclone part 521 and the inner surface of the dust container 510, dusts stored between the cyclone part 521 and the dust container 510 are moved toward the dust discharge part 523 by the air. Then, the dusts are sucked into the cyclone part 521 through the dust discharge part 523.

That is, when the external air is introduced into the dust container 510, the cyclone flow within the cyclone part 521 is instantly broken. As a result, the dusts stored in the duct container together with air are sucked into the cyclone part 521 to discharge the dusts from the dust container 510.

Thus, according to the current embodiment, the dusts stored in the dust container 510 may be discharged without separating the dust container 510 from the nozzle body 10 by a user. Therefore, user's convenience may be improved.

Also, the dusts and air sucked into the cyclone part 521 are discharged through the air discharge part 526 and moved into the connection tube 30.

Here, the external air sucked into the dust container 510 flows into the plurality of passages 552 and 554. Thus, since the air flows overall within the dust container 510, the dusts stored in the dust container 510 may be effectively discharged from the dust container 510.

When a force applied to the compression button 531 is removed, the compression button 531 returns to an original position thereof and the opening/closing member 534 closes the suction holes 512.

Hereinafter, a fifth embodiment will be described. The current embodiment is equal to the first embodiment except a constitution of a vibration member. Thus, different points therebetween will be mainly described, and also, the same parts as those of the first embodiment will be denoted by the same description and reference numeral.

Figure 18:
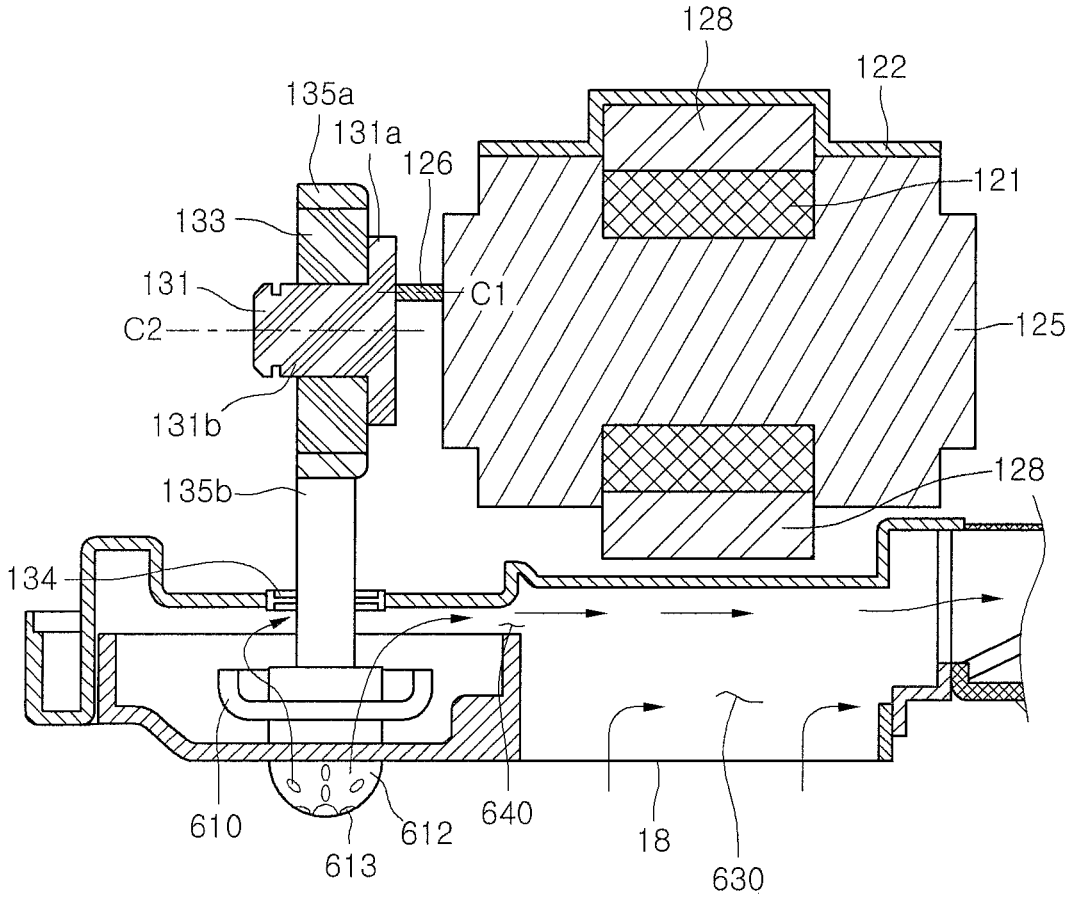
FIG. 18 is a sectional view illustrating a structure and effect of a nozzle according to a fifth embodiment.

FIG. 18 is a sectional view illustrating a structure and effect of a nozzle according to a fifth embodiment.

Referring to FIG. 18, a plurality of protrusion members 612 for striking a cleaning surface when a vibration member 610 is vibrated is disposed under the vibration member 610 according to a fifth embodiment. The protrusion members 612 protrude downward from a bottom surface of the vibration member 610.

A plurality of suction holes 613 for sucking dusts separated from the cleaning surface by the protrusion members 612 is defined in the protrusion member 612.

Thus, when the vibration member 610 is vibrated, the vibration member 610 strikes the cleaning surface the cleaning surface, e.g., bedding to shake off the dusts from the cleaning surface. The a portion of the shaken-off dusts passes through the suction holes 613 and is sucked into a nozzle body 10, and the other portion of the dusts passes through a main suction hole 18 and is sucked into the nozzle body 10.

The nozzle body 10 includes a first suction passage 630 through which the air and dusts sucked into the main suction hole 18 are moved into a connection tube 40 and a second suction passage 640 through which the dusts and air moved into a receiving space 19 are moved into the first suction passage 630.

Here, the dusts and air moved through the second suction passage 640 may be moved into the receiving space 19 through the suction holes of the protrusion member 612 or directly introduced into the receiving space 19.

Thus, the vibration member 610 may be disposed on the second suction passage 640. Also, the vibration member 610 may constitute a portion of the second suction passage 640.

According to the above-described components, when the protrusion member strikes the cleaning surface, the dusts are separated from the cleaning surface. A portion of the dusts is moved into the second suction passage 640 through the suction holes 613, and the other portion of the dusts is moved into the first suction passage 630 through the main suction hole 18.

The air and dusts moved into the second suction passage 640 may flow into the first suction passage 30.

According to the current embodiment, since a portion of the dusts separated from the cleaning surface by the vibration member 610 is sucked into the second suction passage, scattering of the dusts may be reduced. Also, since the dusts are sucked into the two suction passages, the dusts may be smoothly sucked.

According the proposed embodiments, since the dusts scattered during the vibration of the vibration member are sucked through the suction parts, the dusts may be smoothly sucked.

Also, the dusts on the cleaning surface may be easily separated and sucked through the process in which the vibration member is vibrated. Specifically, the rotation movement by the driving motor may be converted into a linear movement. In addition, the vibration member may repeatedly strike the cleaning surface to easily shake off the dusts from the cleaning surface.

Also, since large dusts as well as fine dusts are easily sucked through the plurality of suction parts to improve suction performance, product reliability may be improved and clean environment may be realized.

Also, when the cleaning surface such as the bedding is cleaned, the vibration member may prevent the bedding from being closely attached to the suction parts to easily suck the dusts into the suction parts.

Also, when the cleaning surface formed of the hard material is cleaned, since the reaction force generated when the vibration member strikes the cleaning surface may be absorbed by the elastic member, the noise occurring when the vibration member strikes the cleaning surface may be reduced.

Also, since the nozzle body includes the dust container, whether cleaning is performed and the dust amount may be easily checked.

Also, since the user can discharge the dust stored in the dust container without separating the dust container from the nozzle body, the user's convenience may be improved.

Also, since the external air sucked into the dust container flows into the plurality of passages, the air flows overall within the dust container. Thus, the dusts stored in the dust container may be effectively discharged from the dust container.

According to the above-described embodiments, since the dusts separated from the cleaning surface by the vibration member may be easily sucked into the nozzle of the cleaner, industrial applicability may be further enhanced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A nozzle for a vacuum cleaner, the nozzle comprising:

a nozzle body defining an exterior of the nozzle;

a vibration member disposed in the nozzle body, the vibration member separating foreign substances from a surface to be cleaned;

a driving motor providing a driving force to the vibration member;

a power transmission unit configured to convert a rotation movement of the driving motor into a linear movement of the vibration member, wherein the vibration member repeatedly strikes the surface to be cleaned using the driving force of the driving motor;

a dust container disposed in the nozzle body to store dust, the dust container having a first suction hole through which external air is sucked; and an opening/closing unit for opening or closing the first suction hole.

2. The nozzle according to claim 1, wherein the power transmission unit comprises an eccentrically rotatable power transmission part.

3. The nozzle according to claim 2, wherein an extension line passing through a center of the power transmission part is spaced from an extension line passing through a rotation shaft of the driving motor.

4. The nozzle according to claim 2, wherein, when the power transmission part is eccentrically rotated, side ends of the vibration member are vertically moved.

5. The nozzle according to claim 1, further comprising a noise reduction part for reducing a noise occurring when the vibration member strikes the surface to be cleaned.

6. The nozzle according to claim 5, wherein the noise reduction part comprises an elastic member.

7. The nozzle according to claim 1, wherein the dust container comprises:

a first passage disposed between the opening/closing unit and the dust container; and a second passage passing through the opening/closing unit.

8. The nozzle according to claim 1, further comprising a second suction hole through which dusts and air pass defined in the vibration member.

9. The nozzle according to claim 1, wherein the nozzle body comprises:

a main suction hole defined in a bottom surface; and an auxiliary suction part disposed on at least one of a front surface, a rear surface, or side surfaces of the nozzle body, the auxiliary suction part being separated from the main suction hole.

* * * * *